US006062833A

United States Patent [19]

Holzapfel et al.

[11] Patent Number: 6,062,833

[45] Date of Patent: May 16, 2000

[54] SPIRAL COMPRESSOR, USEFUL IN PARTICULAR TO GENERATE COMPRESSED AIR FOR RAIL VEHICLES

[75] Inventors: Christian Holzapfel, Lenting; Wilfried Zoerner, Weichs; Robert Frank, Germering, all of Germany

[73] Assignee: Knorr-Bremse Systeme für Schienenfahrzeuge GmbH, Munich, Germany

[21] Appl. No.: 09/000,383

[22] PCT Filed: Jul. 19, 1996

[86] PCT No.: PCT/DE96/01330

§ 371 Date: Jan. 30, 1998

§ 102(e) Date: Jan. 30, 1998

[87] PCT Pub. No.: WO97/05390

PCT Pub. Date: Feb. 13, 1997

[30] Foreign Application Priority Data

Jul. 31, 1995 [DE] Germany ..... 195 28 071

[51] Int. Cl.[7] ..... F01C 1/02

[52] U.S. Cl. ..... 418/55.3; 418/55.5; 418/57; 418/101

[58] Field of Search ..... 418/55.3, 55.4, 418/55.5, 57, 101

[56] References Cited

U.S. PATENT DOCUMENTS

| | | | |
|---|---|---|---|
| 3,994,635 | 11/1976 | McCullough | 418/57 |
| 4,954,056 | 9/1990 | Muta et al. . | |
| 5,024,589 | 6/1991 | Jetzer et al. | 418/55.3 |
| 5,295,808 | 3/1994 | Machida et al. | 418/55.5 |
| 5,346,374 | 9/1994 | Güttinger | 418/101 |
| 5,752,816 | 5/1998 | Shaffer | 418/57 |
| 5,938,419 | 8/1999 | Honma et al. | 418/55.4 |

FOREIGN PATENT DOCUMENTS

| | | |
|---|---|---|
| 0548002 | 6/1993 | European Pat. Off. . |
| 3604235 | 8/1987 | Germany . |
| 4159477 | 6/1992 | Japan . |

*Primary Examiner*—Thomas Denion
*Assistant Examiner*—Thai-Ba Trieu
*Attorney, Agent, or Firm*—W. F. Fasse; W. G. Fasse

[57] ABSTRACT

A preferably totally oil-free spiral compressor (1) with a high suction volume flows and a high compression ratio, is useful in particular to generate compressed air for rail vehicles. The compressor includes two spirals arranged on one side only, and includes measures to exactly guide both spirals relative to each other. For that purpose, a compression crown (15) is connected to and axially spaced from a first one of the spirals (7), and the second spiral (9) is positively guidedly driven within the compression crown (15) by a positive guidance arrangement. The positive guidance arrangement includes support rollers (17) that extend axially from the second spiral toward the compression crown and that are engaged and constrained to roll in bores (19) let into the compression crown (15) and shaped as guiding rings. By these measures, both spirals carry out orbital movements with respect to each other, as a result of the offset of their axes and under the positive guidance provided by the support rollers that roll in the bores. Also, to counteract axial forces exerted by the spirals, pressure chambers (35) are provided between the compression crown and the second spiral, to exert a counter force that urges the first and second spirals axially together.

20 Claims, 2 Drawing Sheets

SPIRAL COMPRESSOR, USEFUL IN PARTICULAR TO GENERATE COMPRESSED AIR FOR RAIL VEHICLES

FIELD OF THE INVENTION

The invention relates to a spiral compressor having two intermeshing spiral compressor disks or scroll members rotating about respective axes that are offset from one another, so as to cause a motion of the spiral disks relative to each other to generate the compression effect.

BACKGROUND INFORMATION

In the generation of compressed air, and particularly in the oil-free generation of compressed air in rail vehicles, the compressor technology is subject to special requirements as a result of the large quantities of air that are to be generated and the extremely rough operating conditions. Complete operability must be assured even under rough environmental conditions (temperature, vibrations, shocks, etc.).

In the field of rail vehicles, oil-free spiral compressors are receiving ever more attention, especially in order to prevent the formation or accumulation of oil-containing condensate and in order to simplify the maintenance. Because the capacity of the compressors is to be greatly increased (for example suction volume flows of approximately 1600 1/min) in applications in rail vehicles, in comparison to the typical capacity of present conventional oil-free spiral compressors which are commercially available, and because of the subsequent high loads applied to the spiral compressor as a consequence thereof, it is not possible to simply enlarge such conventional compressors, especially in view of the very high axial forces which have the tendency to push the spirals of the compressor apart from one another. In so-called one-sided spiral arrangements, the support or counter bearing of such axial forces is particularly problematic, since very large bearings are required. These problems are increased in view of the required oil-free compression, due to which it is very difficult to remove or dissipate the frictional power or heat of the bearings. For the above mentioned reasons, compressors having a one-sided spiral arrangement have to date been regarded as not usable in the field of rail vehicles.

It is a further problem in such spiral compressors that the effort and complexity required for providing an "anti-rotation arrangement", which ensures the correct relative positioning of the two spirals, must be held as low as possible. According to the prior art, an Oldham-type coupling was generally used, but such a coupling is relatively unsuitable for larger units as well as for oil-free compressors. Conventional adjacent eccentric arrangements involve a considerable structural effort and complexity, especially in view of the great number of required bearings.

SUMMARY OF THE INVENTION

In view of the above, it is an object of the invention to construct a spiral compressor, which preferably operates in a completely oil-free manner with a one-sided spiral arrangement, such that an exact relative positioning of the two spirals is ensured, even for large suction volume flows as well as for large compression ratios. Especially, unnecessary frictional engagement or meshing that could lead to jamming is to be prevented from occurring during the relative movement of the two spirals as necessary for forming the compression pockets. The invention further aims to avoid or overcome the disadvantages of the prior art, and to achieve additional advantages, as apparent from the present description.

The above objects have been achieved in a spiral compressor according to the invention, comprising a housing, first and second rotation bearings supported in the housing with respective first and second axes of the first and second bearings being laterally offset from each other, a first spiral disk connected to a first shaft that is rotatably supported in the first rotation bearing, and a compression crown that is rotatably arranged at an axial spacing away from the first spiral disk and that is connected to the first spiral disk so as to rotate therewith. The compression crown has at least one drive engagement opening on a side thereof facing toward the first spiral disk. The compressor further comprises a second spiral disk that is arranged in the axial spacing between the compression crown and the first spiral disk so as to intermesh with the first spiral disk, and that is connected to a second shaft that is rotatably supported in the second rotation bearing. Respective shaft axes of the first and second shafts are laterally offset from each other and the first and second spiral disks undergo a relative motion relative to each other for generating a compression effect when the first and second spiral disks respectively rotate about the respective shaft axes. The compressor further includes at least one drive engagement stud member that is connected to and extends from a back side of the second spiral disk facing toward the compression crown, and that extends into and guidedly movably engages in the drive engagement opening. Further, preferably, the drive engagement openings comprise bored holes or engagement bores, and the drive engagement studs comprise support rollers guidedly running around in the engagement bores.

The positive guidance achieved by means of the support rollers provides a so-called "anti-rotation mechanism " between the spirals, i.e. this mechanism does not prevent the rotation of the spirals relative to the housing, but rather a relative rotation of both spirals relative to each other. Due to the offset of the axes of the two shafts of the spirals, these carry out orbital movements relative to each other, which are required in order to allow the formation of the suction and compression pockets for generating the compressed air. Thus, in an advantageous manner, the support rollers are effective as carrier or driver members of one of the spirals relative to the other spiral, and simultaneously they effectuate the relative motion necessary for forming the suction and compression pockets due to the degree of freedom of their rolling movement in the engagement bores.

Advantageous embodiments and further details are recited in further claims.

BRIEF DESCRIPTION OF THE DRAWINGS

The invention is explained below in connection with an example embodiment with reference to the accompanying drawings.

DETAILED DESCRIPTION OF PREFERRED EXAMPLE EMBODIMENT AND OF THE BEST MODE OF THE INVENTION

Figure 1:
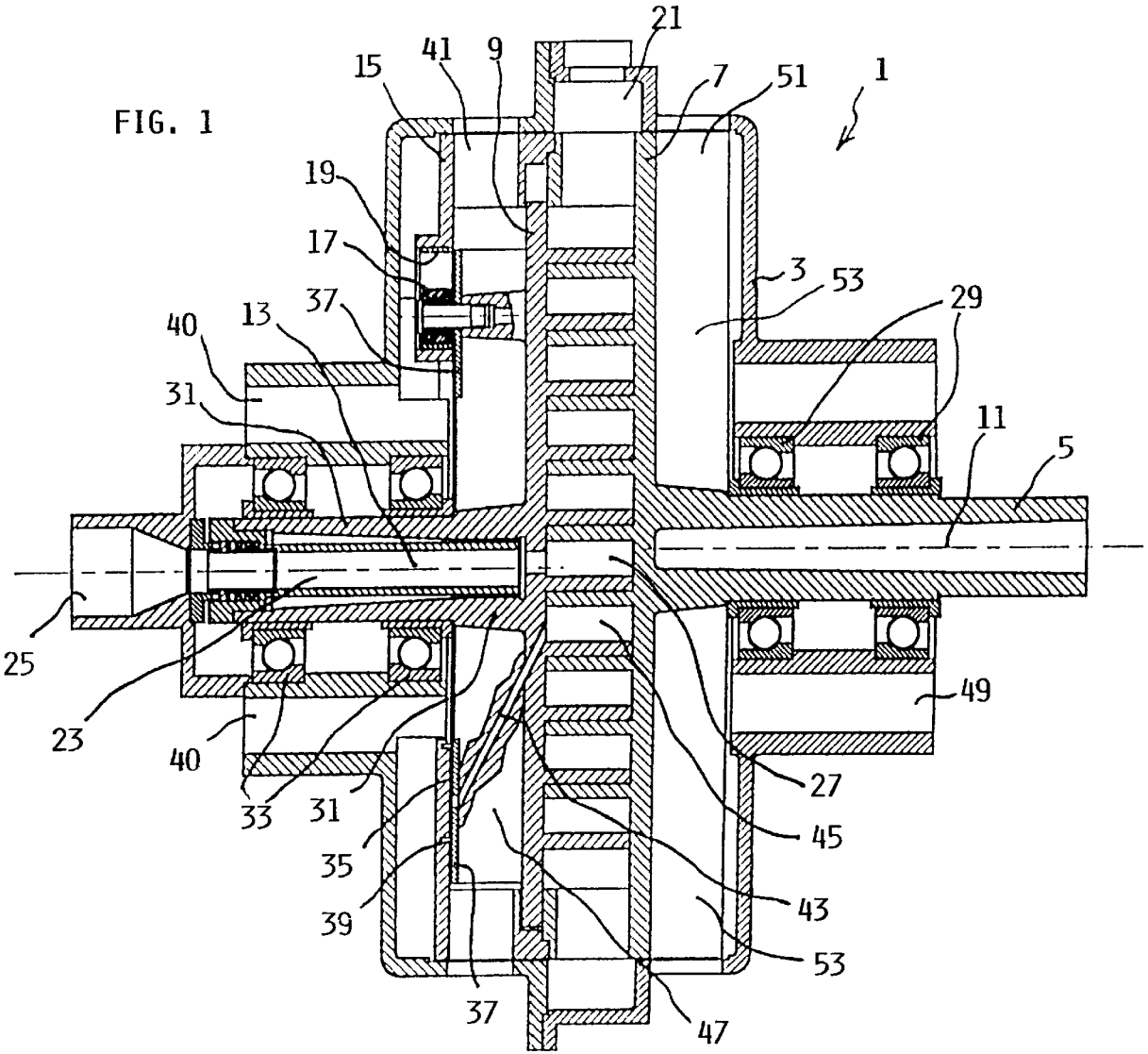
FIG. 1 is a sectional view of the spiral compressor according to the invention.

A spiral compressor 1 provided with a one-sided spiral arrangement is shown in FIG. 1. This spiral compressor 1 includes a housing 3 in which two interengaging spirals run, namely a spiral disk or spiral 7 driven by a shaft 5 and a spiral disk or spiral 9 that followingly trails or lags along with the spiral 7. The two spirals each respectively carry out a purely rotational motion. Due to the purely rotational motion of each one of the spirals, no imbalance forces arise as long as the spirals are respectively each properly balanced by themselves.

The orbiting relative motion of both spirals relative to one another necessary for the compression effect is achieved in that the respective rotation axes 11 and 13 of the two spirals are offset a certain spacing relative to one another. Furthermore, the trailing or lagging spiral 9 is enclosed by a compression crown 15 which is rigidly screwed or otherwise connected to the driven spiral 7 (by securing means which are not shown). In order to ensure the function of the so-called "co-rotating" principle of both spirals, i.e. to ensure the correct relative positioning of the two spirals relative to each other at all times, an "anti-rotation mechanism" in the form of a positive guidance arrangement is effective between the two spirals. The positive guidance arrangement comprises three drive engagement studs or particularly support rollers 17 that are carried by the trailing or lagging spiral 9 and that run in drive engagement openings, or particularly bores 19 that are arranged in the compression crown 15 at equal angular spacings from one another. Accordingly, three support rollers 17 respectively arranged at an angular spacing of 120° relative to one another are associatedly provided for three bores 19 arranged at an equal angular spacing relative to one another. Since the compression crown 15 rotates with the driven spiral 7, the compression crown 15 in turn carries along the spiral 9 by means of the walls of the bores 19 engaging with the support rollers 17. As a result the spiral 9 is trailingly or laggingly carried along, whereby the two spirals carry out "orbiting " movements relative to each other within the degree of freedom of the bores 19 due to the offset of the rotation axes 11 and 13. These orbiting movements of the spirals relative to each other form spiral pockets having a varying volume between the two spirals, whereby the spiral pockets contribute to compressing the gas or air volume that is sucked in through the suction channel 21. The compressed air is pushed out of the compression space 27 through an axial bore 23 lying in the center of the spiral 9 and through a pressure connection 25. The driven shaft 5 of the spiral 7 runs in a bearing 29, while the shaft 31 of the following or trailing spiral 9 runs in a bearing 33.

Figure 2:
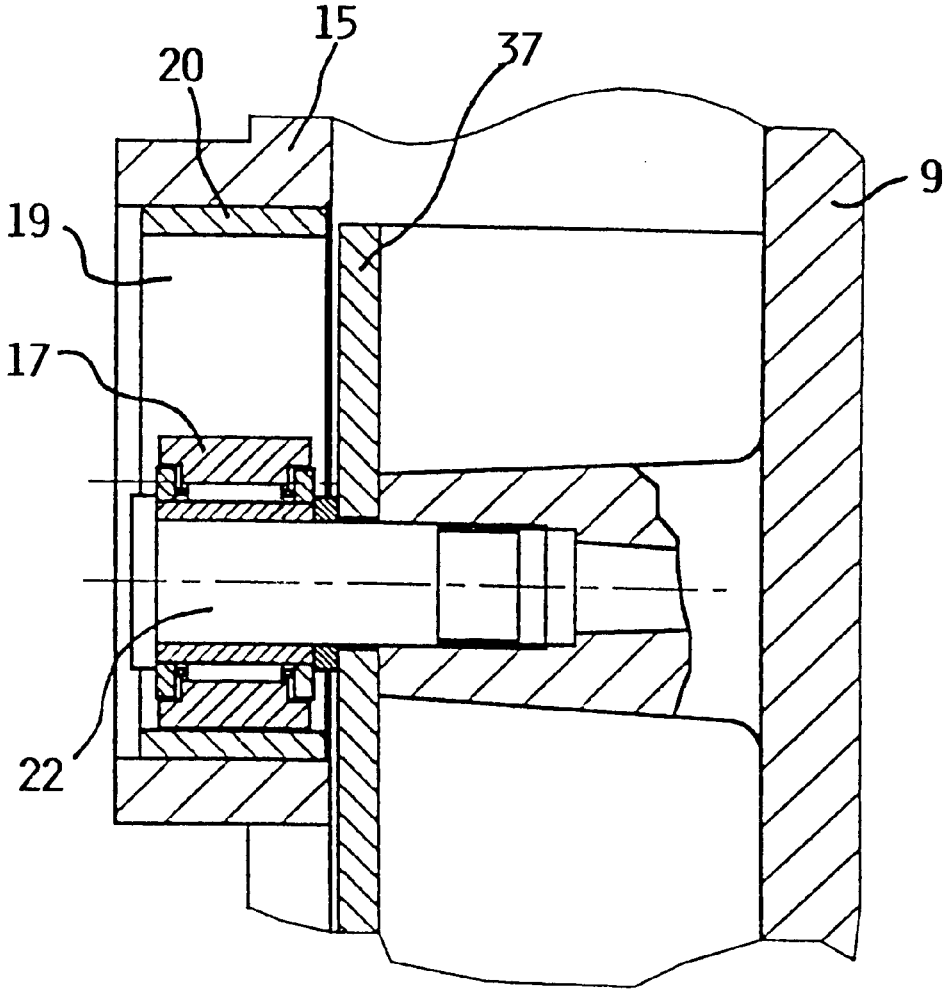
FIG. 2 is an enlarged detail sectional view of one of the support rollers within the engagement bore let into the compression crown.

One of the support rollers 17 within the bore 19 which guides it is shown in an enlarged detail sectional view in FIG. 2. In the illustrated embodiment, the bore 19 is embodied as a guide ring in a manner that a steel bushing 20 is provided for achieving the most wear-free supporting contact possible for the support roller. In order to take up small thermal expansions in a stress-free manner, the support rollers may carry an elastic synthetic material sleeve (which is not shown) on their outer circumference, or they may be coated with a synthetic material. In the example embodiment shown in FIG. 2, the support rollers are secured to the spiral 9 by means of bolts or screws 22, which make it possible to exchange the support rollers in a simple manner.

In a spiral compressor having the above described one-sided spiral arrangement, with a completely oil-free operation, it is desired to achieve a large compression ratio without causing an excessive loading of the bearings due to the axial forces acting on the spirals due to such a high compression ratio. In order to counter this problem, an apparatus for axial force compensation is provided. This apparatus comprises pressure chambers 35, which are provided between the inner side of the compression crown 15 and an annular or ring disk 37 arranged on the back side of the spiral 9. In the illustrated embodiment, the pressure chambers 35 are the very small volumes that are respectively formed between the annular disk 37 and the facing inner surface of the compression crown 15. The size and the shape of the pressure chambers are determined by dry-running seals 39 which seal the pressure chambers relative to external air, i.e. relative to the external air volume between the cooling air inlet 40 and the cooling air outlet 41 of the spiral 9. In the illustrated embodiment, three pressure chambers 35 are provided respectively located between the bores 19 at equal angular spacings of 120° relative to one another. These three pressure chambers 35 are respectively provided with compressed air from the compression pockets 45 of the spirals through passages or bores 43.

During operation of the spiral compressor, a pressure is developed in the pressure chambers 35 due to the above described pressure supply to the pressure chambers 35, such that this developed pressure presses the two spirals toward one another, since the compression crown 15 is connected to the spiral 7 and the annular disk 37 is supported by the spiral 9 on the rearward facing side or portion of the spiral 9, for example by radial cooling fins 47 connected to the spiral 9 or by the bearing journal studs or pins of the support rollers 17, which pass through the annular disk 37 at angular spacings from one another, as can be seen in the upper sectional half of the drawing. Since the spirals 7 and 9 are pressed respectively toward one another by means of the above described apparatus for axial force compensation with simultaneous positive guidance, the two bearings 29 and 33 are freed from axial forces to the same extent. For this reason, oil-free operating spiral compressors of the described type can also operate with a large compression ratio and a large suction volume.

In addition to the above mentioned cooling air arrangement for the spiral 9, a corresponding cooling system is also provided on the spiral 7. Namely, a cooling air inlet 49 and a cooling air outlet 51, as well as radial cooling fins 53 connected to the spiral 7, are provided.

We claim:

1. A spiral air compressor comprising:

a housing, first and second rotation bearings supported in said housing with respective first and second axes of said first and second bearings being laterally offset from each other, a first spiral disk connected to a first shaft that is rotatably supported in said first rotation bearing, a compression crown that is rotatably arranged at an axial spacing away from said first spiral disk and that is connected to said first spiral disk so as to rotate therewith, wherein said compression crown has at least one drive engagement opening on a side thereof facing toward said first spiral disk, a second spiral disk arranged in said axial spacing between said compression crown and said first spiral disk so as to intermesh with said first spiral disk, and connected to a second shaft that is rotatably supported in said second rotation bearing, wherein respective shaft axes of said first and second shafts are laterally offset from each other and said first and second spiral disks undergo a relative motion relative to each other for generating a compression effect when said first and second spiral disks respectively rotate about said respective shaft axes, and at least one drive engagement stud member that is connected to and extends from a back side of said second spiral disk facing toward said compression crown, and that extends into and guidedly movably engages in said drive engagement opening.

2. The spiral air compressor according to claim 1, further in combination with a rail vehicle for which said compressor is used to generate compressed air.

3. The spiral air compressor according to claim 1, wherein said compression crown has a plurality of said drive engagement openings uniformly angularly spaced apart from one another on said side facing toward said first spiral disk, and comprising a plurality of said drive engagement stud members uniformly angularly spaced from one another extending from said back side of said second spiral disk and respectively engaging in said drive engagement openings.

4. The spiral air compressor according to claim 3, wherein each said drive engagement stud member respectively comprises a support roller that is rotatably supported relative to said second spiral disk and that positively guidedly rolls along a wall of a respective one of said drive engagement openings.

5. The spiral air compressor according to claim 4, wherein each said drive engagement opening is a respective circular bored hole let into said side of said compression crown facing toward said first spiral disk.

6. The spiral air compressor according to claim 5, comprising exactly three of said support rollers angularly offset from one another respectively by 120°, and exactly three of said bored holes angularly offset from one another respectively by 120°.

7. The spiral air compressor according to claim 1, wherein each said at least one drive engagement stud member respectively comprises a support roller that is rotatably supported relative to said second spiral disk and that positively guidedly rolls along a wall of a respective one of said at least one drive engagement opening.

8. The spiral air compressor according to claim 7, wherein said support roller of each said at least one drive engagement member respectively comprises an elastic synthetic plastic material on at least a rolling surface thereof.

9. The spiral air compressor according to claim 7, wherein each said at least one drive engagement stud member further comprises a bolt on which said respective support roller is rotatably supported, wherein said second spiral disk has at least one axially directed projection on said back side thereof, and wherein said bolt is respectively screwed into said projection.

10. The spiral air compressor according to claim 1, wherein at least one pressure chamber is formed within said housing, and is adapted to be pressurized so as to apply an axial counter force that axially supports said first and second spiral disks relative to each other and compensates for an axial force exerted by said spiral disks.

11. The spiral air compressor according to claim 10, comprising a plurality of said pressure chambers.

12. The spiral air compressor according to claim 11, further comprising an annular disk arranged between said compression crown and said second spiral disk adjacent said compression crown, wherein said pressure chambers are formed between said compression crown and said annular disk, compression pockets are formed between said first and second spiral disks, and passages connect said compression pockets to said pressure chambers so as to be adapted to provide compressed air from said compression pockets to said pressure chambers.

13. The spiral air compressor according to claim 12, further comprising a respective dry-running seal member let into said compression crown and bounding each said pressure chamber, wherein said annular disk overlaps said pressure chambers and is adapted to move relative to said compression crown with a gliding velocity corresponding to a relative velocity of said relative motion between said first and second spiral disks, and wherein said annular disk has holes therethrough communicating with said passages to connect said compression pockets to said pressure chambers.

14. The spiral air compressor according to claim 12, wherein said second spiral disk includes a disk body and radially extending cooling fins that protrude from said disk body toward said annular disk, and said annular disk is braced against said cooling fins such that a pressure developed in said pressure chambers applies a force urging said compression crown and said annular disk apart from each other, whereby said first spiral disk connected to said compression crown and said second spiral disk braced against said annular disk by said cooling fins are urged toward each other.

15. The spiral air compressor according to claim 12, wherein said annular disk is braced against said second spiral disk such that a pressure developed in said pressure chambers applies a force urging said compression crown and said annular disk apart from each other, whereby said first spiral disk and said second spiral disk are urged toward each other.

16. The spiral air compressor according to claim 12, comprising exactly three of said pressure chambers respectively angularly offset from each other by 120°.

17. The spiral air compressor according to claim 11, wherein said compression crown has a plurality of said drive engagement openings, and wherein each respective one of said drive engagement openings is arranged angularly between two respective neighboring ones of said pressure chambers.

18. The spiral air compressor according to 1, wherein said first shaft is externally driven so as to rotationally drive said first spiral disk, and wherein said at least one drive engagement stud member respectively engaged in said at least one drive engagement opening causes said second spiral disk to be rotationally carried along by the rotation of said first spiral disk.

19. The spiral air compressor according to claim 1, wherein said compression crown is rigidly connected with said first spiral disk.

20. The spiral air compressor according to claim 1, wherein a suction air inlet channel is provided at least partially circumferentially around said intermeshing first and second spiral disks and is adapted to supply air into compression pockets formed between said intermeshing first and second spiral disks, said compression pockets are adapted to compress the air, and a compressed air outlet channel is provided as an axial bore within said second shaft communicating with said compression pockets.

* * * * *